United States Patent [19]

Weir

[11] 4,238,060

[45] Dec. 9, 1980

[54] APPARATUS FOR FOLDING AND STACKING OF PIECES OF LAUNDRY

[75] Inventor: Henry J. Weir, Dublin, Ireland

[73] Assignee: Beta S.A., Luxembourg

[21] Appl. No.: 970,278

[22] Filed: Dec. 18, 1978

[30] Foreign Application Priority Data

Dec. 29, 1977 [DK] Denmark ..... 5832/77

[51] Int. Cl.[3] ..... B65H 15/107

[52] U.S. Cl. ..... 223/37; 493/416; 493/937

[58] Field of Search ..... 223/37; 270/61 R, 62, 270/66, 78, 82, 85

[56] References Cited

U.S. PATENT DOCUMENTS 3,467,370 9/1969 Grantham ..... 270/85

4,061,327 12/1977 Blessing ..... 270/78

FOREIGN PATENT DOCUMENTS 183669 5/1963 Sweden ..... 223/37

1336304 11/1973 United Kingdom ..... 223/37

*Primary Examiner*—Louis Rimrodt

*Attorney, Agent, or Firm*—Ostrolenk, Faber, Gerb & Soffen

[57] ABSTRACT

The disclosure concerns apparatus for stacking folded laundry. A pair of clamping jaws is supported for swinging about a swinging axis. A first pneumatic cylinder is connected through a first rack with a first pinion connected with the first clamping jaw. A second pneumatic cylinder is connected through a second rack with a second pinion connected with the other clamping jaw. The first pneumatic cylinder is stronger than the second pneumatic cylinder, whereby when both pneumatic cylinders are operated, the first pneumatic cylinder swings the clamping jaws together around the swinging axis to deliver laundry to a stacking table and the second pneumatic cylinder acts in opposition to the first pneumatic cylinder to cause the clamping jaws to clamp together.

10 Claims, 1 Drawing Figure

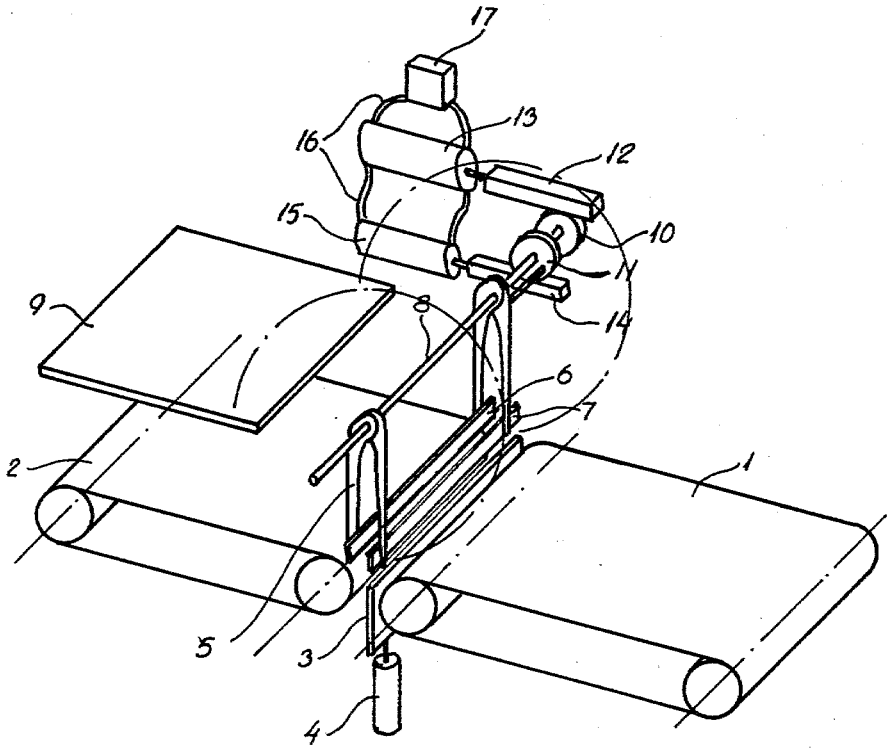
17
16
13
12
15
10
11
9
8
14
6
7
2
1
5
3
4

APPARATUS FOR FOLDING AND STACKING OF PIECES OF LAUNDRY

The present invention relates to an apparatus for simultaneous stacking and folding of pieces of laundry, which apparatus comprises a gripper with a pair of elongate jaws, which within certain limits are movable towards and apart from each other about an axis being parallel with the jaws, which jaws are arranged to grip the piece of laundry to be folded along the folding line; and driving means for swinging the gripper about a swinging axis coaxial with said axis with such a speed that the piece of laundry is radially stretched outwardly and placed on a table having an edge parallel with the swinging axis in distance from said swinging axis, on which table the piece of laundry is released from the gripper.

In a known apparatus of this kind the gripper consists of two elongate jaws between which a pneumatic cylinder is arranged to perform the closing movement of the jaws catching the piece of laundry along the folding line. The masses of the movable parts in this arrangement are large and at the same time it is complicated to feed compressed air to the cylinder on the gripper making a pivoting movement of 270°. The operating speed of the known apparatus is owing to the large masses not sufficient to follow the calenders feeding the apparatus for which reason the apparatus has not been widely used.

An object of the present invention is to improve the apparatus in such a way that the movement of inertia of the swinging masses is reduced in order to obtain a quicker working cycle of the apparatus. A further object is to obtain a simple and reliable construction of the apparatus.

This is obtained according to the invention in an apparatus characterized in that each of the two jaws are rigidly connected with pinions each in engagement with racks driven in their longitudinal direction by pneumatic cylinders, arranged to apply opposed moments of different size on the jaws.

As the two cylinders or power devices driving the jaws are mounted stationarily and therefore do not participate in the swinging movement, the moment of inertia is reduced. Further the mechanical construction is simple and the functioning extremely reliable, as the swinging movement cannot start until the jaws are closed with maximum gripping force. Correspondingly, a complete release is obtained before the gripper makes its return swinging to its starting position. The pneumatic circuit is extremely simple as the two cylinders may be connected in parallel to a common control valve. As the two cylinders are stationary and are not participating in the swinging movement, the complication of transferring compressed air to a cylinder on the gripper is avoided.

According to a preferred embodiment according to the invention the pinions have the same diameter while one of the cylinders is approximately double the size of the other. It is then possible to use a series of identical components for the two jaws in order to simplify the construction and make it economical. At the same time the practical arrangement is obtained of the mechanism automatically performing the swinging movement as soon as the jaws are pressed against each other with a predetermined force depending on the size of the smaller cylinder.

The invention is described in details in the following with reference to the drawings in which an apparatus according to the invention for folding and stacking of pieces of laundry is shown schematically.

In the drawing is schematically shown a combined stacking and folding apparatus according to the invention. On a conveyor 1 the pieces of laundry to be stacked are fed. In line with the conveyor 1 a further conveyor 2 is arranged. Between the two conveyors 1,2 there is a space sufficient for a folding plate 3 to be moved up- and downwards between the conveyors. The folding plate 3 is driven for example by a pneumatic cylinder 4. Above the folding plate 3 a pivotable gripper 5 is arranged, which gripper comprises two elongate jaws 6 and 7. The gripper 5 is arranged to swing over an angle of 270° by means of a shaft 8 parallel with the folding plate 3. Above one of the conveyors at the end of the swinging movement of the gripper 5 a receiving table 9 is arranged, on which table the pieces of laundry being folded are placed in a stack.

The gripper 5 has driving means providing a movement of the jaws against each other and a swinging movement. Further, before the returning of the gripper to its starting position, the jaws must be opened. These driving means comprise a pinion 10 mounted on the shaft 8 on which the jaw 6 is also mounted. The jaw 7 is mounted on the shaft in such a way that it is pivotable a few degrees against and away from the jaw 6. The jaw 7 is rigidly connected with a second pinion 11 which is also rotably mounted on the shaft 8. The pinions 10 and 11 have the same diameter. A first rack 12 is in engagement with the pinion 10. The rack 12 is slidable in its longitudinal direction by means of a pneumatic cylinder 13. A second rack 14 similarly driven by a second pneumatic cylinder 15 is in engagement with the pinion 11. The first pneumatic cylinder 13 has a greater volume than the second cylinder and is double the size of the second cylinder.

When a piece of laundry is placed, for example with its middle at the folding plate 3, the folding plate 3 is moved upwards by means of the air cylinder 4, whereby a fold of the piece of laundry is placed between the two jaws 6,7. Then the two cylinders 13,15 are activated in such a way that the pinions are driven in opposite directions by means of the racks 12,14. The piece of laundry thereby is held by the gripper and the folding plate 3 may return to its starting position. As the first cylinder 13 has a greater volume than the second, the force of the latter is supressed and the gripper swings around to the receiving table 9. During the swinging movement the piece of laundry is radially stretched outwards by the centrifugal force and is delivered flat on the receiving table or on top of the stack of the laundry placed on the table. Thereafter the cylinders 13,15 are activated oppositely, whereby the jaws are opened and owing to the greater volume of the first cylinder the gripper is returned to its starting position above the folding plate. The two pneumatic cylinders may be connected in parallel by means of pneumatic lines 16 to a single, common control valve 17.

What is claimed is:

1. Apparatus for simultaneously folding and stacking pieces of laundry, comprising:

a swing axis; a pair of clamping jaws each carried on said spring axis and swingable together about said swing axis; said clamping jaws being normally opposed;

means for folding a piece of laundry and delivering a folded portion thereof between said jaws when the latter are open;

first driving means connected with one said jaw for swinging said one jaw in one direction about said swing axis;

second driving means connected with the other said jaw for driving said other jaw to swing counter to said one direction about said swing axis;

said first and second driving means including respective first and second power devices on relatively stationary mountings;

said first driving means being stronger than said second driving means, whereby as both said driving means operate simultaneously, said first driving means overcomes force exerted by said second driving means and swings both said jaws in said one direction around said swing axis and said second driving means causes said jaws to clamp together thereby gripping a folded portion of a laundry piece positioned between said jaws.

2. The apparatus according to claim 1, further comprising means for causing said first and said second driving means to respectively reverse the driving forces applied to said jaws, for separating said jaws.

3. The apparatus according to claim 1, further comprising a table having an edge substantially parallel to said swing axis and spaced from said swing axis and said table being placed such that following predetermined motion of said jaws in said one direction, said jaws deliver a piece of laundry clamped in said jaws onto said table.

4. The apparatus according to claim 3, further comprising means for causing said first and said second driving means to respectively reverse the driving forces applied to said jaws, for separating said jaws; said driving means reversal causing means being adapted to cause reversal upon said jaws delivering laundry onto said table.

5. The apparatus according to claim 1, wherein the power devices of each of said first and said second driving means respectively comprises a pneumatic cylinder connected with the respective one of said first and said second jaws; said first driving means cylinder being adapted to apply greater pneumatic force than said second driving means cylinder.

6. The apparatus according to claim 5, further comprising means for causing said pneumatic cylinders to respectively reverse the direction of their driving forces which they apply to the respective said jaws, for separating said jaws.

7. Apparatus for simultaneously folding and stacking pieces of laundry, comprising:

a swing axis; a pair of clamping jaws each carried on said spring axis and swingable together about said swing axis; said clamping jaws being normally opposed;

means for folding a piece of laundry and delivering a folded portion thereof between said jaws when the latter are open;

first driving means connected with one said jaw for swinging said one jaw in one direction about said swing axis;

second driving means connected with the other said jaw for driving said other jaw to swing counter to said one direction about said swing axis;

said first driving means being stronger than said second driving means, whereby as both said driving means operate simultaneously, said first driving means swings both said jaws in said one direction around said swing axis and said second driving means causes said jaws to clamp together;

the power devices of each of said first and said second driving means respectively comprising a pneumatic cylinder connected with the respective one of said first and said second jaws; said first driving means cylinder being adapted to apply greater pneumatic force than said second driving means cylinder;

said first and said second driving means respectively further comprising a first and second pinion; both said pinions being rotatable about said swing axis; the respective said pneumatic cylinder being connected with said one jaw for swinging said one jaw and said second pinion being connected with said other jaw for swinging said other jaw.

8. The apparatus according to claim 1, further comprising a table having an edge substantially parallel to said swing axis and spaced from said swing axis and said table being placed such that following predetermined motion of said jaws in said one direction, said jaws deliver laundry clamped in said jaws onto said table.

9. The apparatus according to claim 1, wherein the connection between each said pneumatic cylinder and its said pinion comprises a respective rack movable by the respective pneumatic cylinder and each said rack being in engagement with the respective said pinion for rotating it as said rack is moved by the respective said pneumatic cylinder.

10. The apparatus according to either of claims 1 or 9, wherein both of said first and said second pinions have the same diameter.

* * * * *